United States Patent [19]

Poppe

[11] Patent Number: 4,637,062

[45] Date of Patent: Jan. 13, 1987

[54] PLASTIC BAG ASSEMBLY INCLUDING A CONDUIT MEMBER

[75] Inventor: Josef Poppe, Tecklenburg, Fed. Rep. of Germany

[73] Assignee: Bischof und Klein GmbH & Co., Fed. Rep. of Germany

[21] Appl. No.: 684,466

[22] Filed: Dec. 21, 1984

[30] Foreign Application Priority Data

Dec. 28, 1983 [DE] Fed. Rep. of Germany ... 8337443[U]

[51] Int. Cl.[4] ..... B65D 30/24

[52] U.S. Cl. ..... 383/54; 383/46; 383/57; 383/59; 383/124

[58] Field of Search ..... 383/44, 45, 46, 48, 383/50, 51, 52, 53, 54, 55, 56, 57, 58, 59, 124, 125, 126

[56] References Cited

U.S. PATENT DOCUMENTS

| | | | |
|---|---|---|---|
| 2,201,675 | 5/1940 | Vogel-Jorgensen | 383/46 |
| 2,275,505 | 3/1942 | Crawford et al. | 383/54 |
| 3,130,897 | 4/1964 | Pokular et al. | 383/46 |
| 3,237,534 | 3/1966 | Lissner | 383/54 X |
| 3,272,093 | 9/1966 | Brockmuller | 383/54 X |
| 3,291,376 | 12/1966 | Goodwin | 383/54 |
| 3,397,622 | 8/1968 | Goodwin | 383/125 X |
| 3,448,666 | 6/1969 | Kappelhoff et al. | 383/125 X |
| 3,979,049 | 9/1976 | Achelpohl | 383/125 |
| 4,049,191 | 9/1977 | Stearley | 383/46 |
| 4,235,366 | 11/1980 | Achelpohl et al. | 206/620 X |
| 4,441,209 | 4/1984 | Lunshof et al. | 383/45 |

FOREIGN PATENT DOCUMENTS

| | | | |
|---|---|---|---|
| 869292 | 3/1953 | Fed. Rep. of Germany | 383/125 |
| WO07948 | 3/1956 | Fed. Rep. of Germany | 383/125 |
| 1486470 | 6/1969 | Fed. Rep. of Germany | 383/54 |
| 483330 | 4/1938 | United Kingdom | 383/46 |

*Primary Examiner*—William Price
*Assistant Examiner*—Bryon Gehman
*Attorney, Agent, or Firm*—Louis E. Marn

[57] ABSTRACT

There is disclosed a bag assembly comprised of a tubularly-shaped bag preform formed of a plastic material defining a top closure portion and a bottom closure portion and provided with an adhesive layer peripherally-disposed about the tubularly-shaped bag preform proximate the top and bottom closure portions. The top closure portion and the bottom closure portion are subsequently formed with corner folds and side folds with the side folds being dimensioned whereby end portions of said side folds are spaced apart from one another upon subsequent folding agent about a fold line. A conduit member including a sleeve portion is mounted on one of the corner folds of the top closure portion by an adhesive layer portion disposed on the corner fold, and sheet members are thereupon mounted over the side and corner folds by adhesive layer portions thereon. After folding of the side fold members about the fold lines, top and bottom closure sheet members are mounted on the top and bottom closure portions.

9 Claims, 6 Drawing Figures

PLASTIC BAG ASSEMBLY INCLUDING A CONDUIT MEMBER

FIELD OF THE INVENTION

This invention relates to a bag assembly, and more particularly to a bag assembly formed of a plastic material.

BACKGROUND OF THE INVENTION

Known bag assemblies formed of a blown film of plastic material include provisions for bonding using a thin layer of a contact adhesive material whereby folds and common bonding are effected after evaportaion of solvent from the adhesive material. Accordingly, the adhesive is applied in layers in an almost dry condition and bonds only to itself, e.g. adhesive layer to layer bonding.

Thus, tubularly-shaped bag preforms, formed for example by blown film techniques, are passed through the bag forming assembly in a manner to minimize contact between adhesive layers, end forming tools, guide bars and the like. However, it has been found that orifices and/or channels are formed between folds during processing of the preforms as a result of inherent resiliency of the plastic material forming the preforms, particularly when forming forces are inadequate to effectively contact adhesive layers to close corner folds, side folds, end folds, etc. thereby resulting in potential subsequent leakage of a packaged product therefrom.

Inadequate contact, and thus potential product leakage, occur as a result of using cover sheets in known assemblies, where the cover sheets are of a thickness greater than the thickness of the bag preform or of common overlapping folds at certain areas of the bottom end closure, since breakage of such cover sheets along a longitudinal direction may readily occur along an edge of side bottom folds by impact-like stresses.

OBJECTS OF THE PRESENT INVENTION

An object of the present invention is to provide a novel bag assembly of greater end closure integrity.

Another object of the present invention is to provide a novel bag assembly permitting assembly at high machine speeds.

Still another object of the present invention is to provide a novel bag assembly formed of plastic material.

SUMMARY OF THE INVENTION

These and other objects of the present invention are achieved by a bag assembly comprised of a tubularly-shaped bag preform formed of a plastic material defining a top closure portion and a bottom closure portion and provided with an adhesive layer peripherally-disposed about the tubularly-shaped bag preform proximate the top and bottom closure portions wherein said top closure portion and said bottom closure portion are subsequently formed with corner folds and side folds with the side folds being dimensioned whereby end portions of said side folds are spaced apart from one another upon subsequent folding about a fold line and wherein a conduit member including a sleeve portion is mounted on one of the corner folds of the top closure portion by an adhesive layer portion disposed on the corner fold, and wherein sheet members are thereupon mounted over the side and corner folds by adhesive layer portions thereon, and wherein after folding of the side fold members about the fold lines top and bottom closure sheet members are mounted on said top and bottom closure portions.

BRIEF DESCRIPTION OF THE DRAWING

A better understanding of the present invention as well other objects and advantages thereof will become apparent upon consideration of the detailed disclosure thereof, especially when taken with the accompanying drawings, wherein.

DETAILED DESCRIPTION OF THE INVENTION

Figure 1:
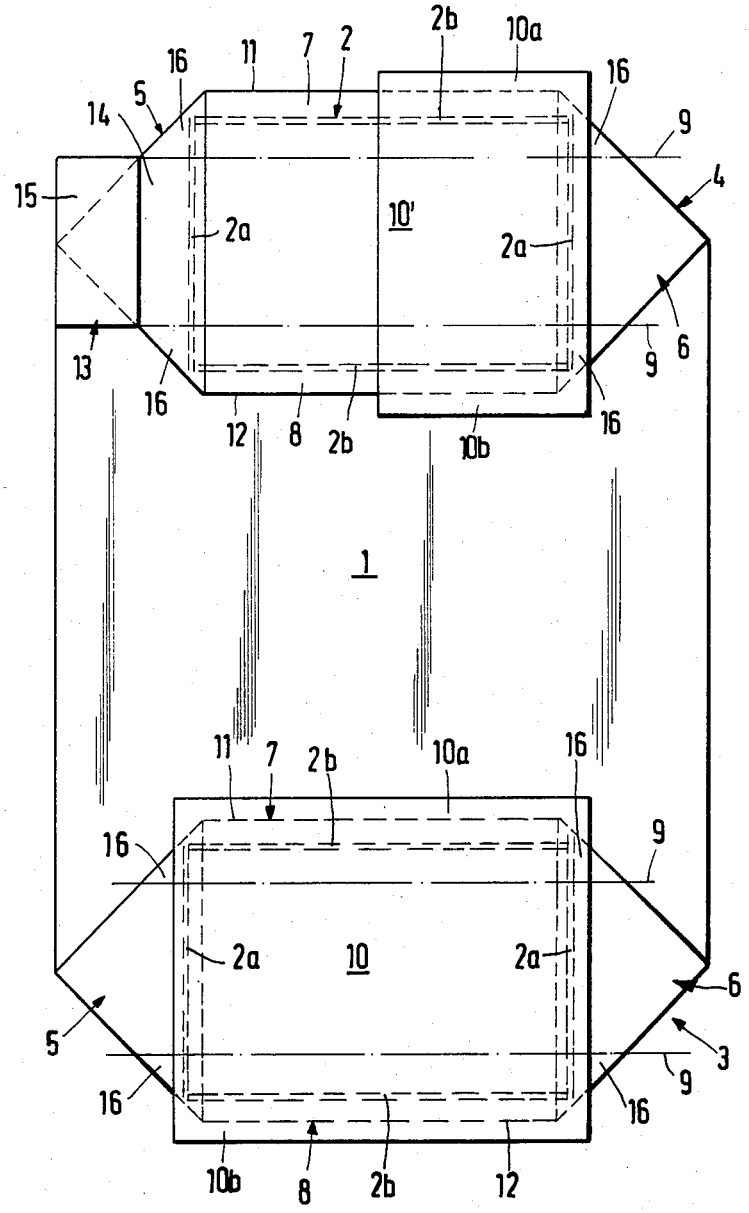
FIG. 1 is an elevational view, somewhat schematic, of one embodiment of a bag assembly of the present invention in a partially assembled state.

Referring now to the drawings, and in particular to FIG. 1, there is illustrated a tubularly-shaped bag preform, generally indicated as 1, formed of a thin film thermoplastic material, such as polyolefin (e.g. polyethylene or the like) after initial shaping to form a bottom closure portion and a top closure portion, generally indicated as 3 and 4, respectively, and having an adhesive layer 2 of a soft and viscous adhesive material peripherally-disposed about an outer surface of the bag preform 1 proximate the bottom and top closure portions 3 and 4.

Suitable adhesive materials include mixtures of isocyanate-modified polyesters with free hydroxyl groups and isocyanate resins dissolved in a solvent. Softness of the adhesive material may be adjusted by increasing surface viscosity at the time of assembly by using polyester resins of a correspondingly low molecular weight whereby bonding is effected between a surface having an adhesive layer and an adhesive-free surface as effectively as contact adhesion between adhesive layers disposed on each contacting surface.

The bottom and top closure portions 3 and 4 are thereafter formed with corner folds, generally indicated as 5 and 6, and with side folds, generally indicated as 7 and 8, in an end closure folding machine (not shown). FIG. 1 illustrates the closure portions in the form of a cross (i.e. side view thereof), although other forms would be apparent to one skilled in the art, together with an appropriate inlet member to cooperate with the top closure portion for introducing a material to be packaged into the bag assembly, as more fully hereinafter discussed.

The adhesive layer 2, referring to FIG. 1, is formed into layer portions **2*a* disposed on corner folds 5 and 6 and of layer portions 2*b* disposed on side folds 7 and 8 on surface portions thereof folded on a side opposite of the surface portions on which the adhesive layer portions 2*a* are disposed on the corner folds 5 and 6**.

To the bottom closure portion 3, there is disposed a sheet member 10 which bonds by adhesive layer portions 2*a* to corner folds 5 and 6 of the bag preform 1. The sheet member 10 including upper and lower side portions 10*a* and 10*b* is dimensional with a height which exceeds the distance between the terminal portions 11 and 12 of side folds 7 and 8, and of a width exceeding the distance between the distance between adhesive layer portions 2*a* disposed on corner folds 5 and 6.

To the top closure 4, there is disposed a sheet member 10' including upper and lower side portions 10*a* and 10*b* of a similar height dimension as sheet member 10, but of a width dimension of about one-half that of sheet member 10, such that the sheet member 10' adheres to a layer portion 2*a* disposed on corner fold 6 of the top closure portion 4. The sheet member 10' may have a larger width dimension, but in no event of a width to effect adherence to adhesive layer portion 2*a* disposed on corner fold 5 of the top closure portion 4.

To the top closure portion 4, there is positioned a filling conduit member, generally indicated as 13, comprised of a sleeve portion 14 and a flap portion 15 whereby the sleeve portion 14 is positioned on adhesive layer portion 2*a* disposed on the corner fold 5 of the top closure portion 4. It will be readily appreciated by one skilled in the art that the bag preform 1 after positioning of the sheet member 10 and 10' and conduit assembly 13 permits vertical passage thereof through a further end folding assembly without concomitant smearing of an adhesive layer thereby permitting of high speed assembly and filling, as distinguished from the adhesive layer configurations of the prior art. The bag assembly of the present invention is filled through the sleeve portion 14 of the filling conduit member 13.

Figure 2:
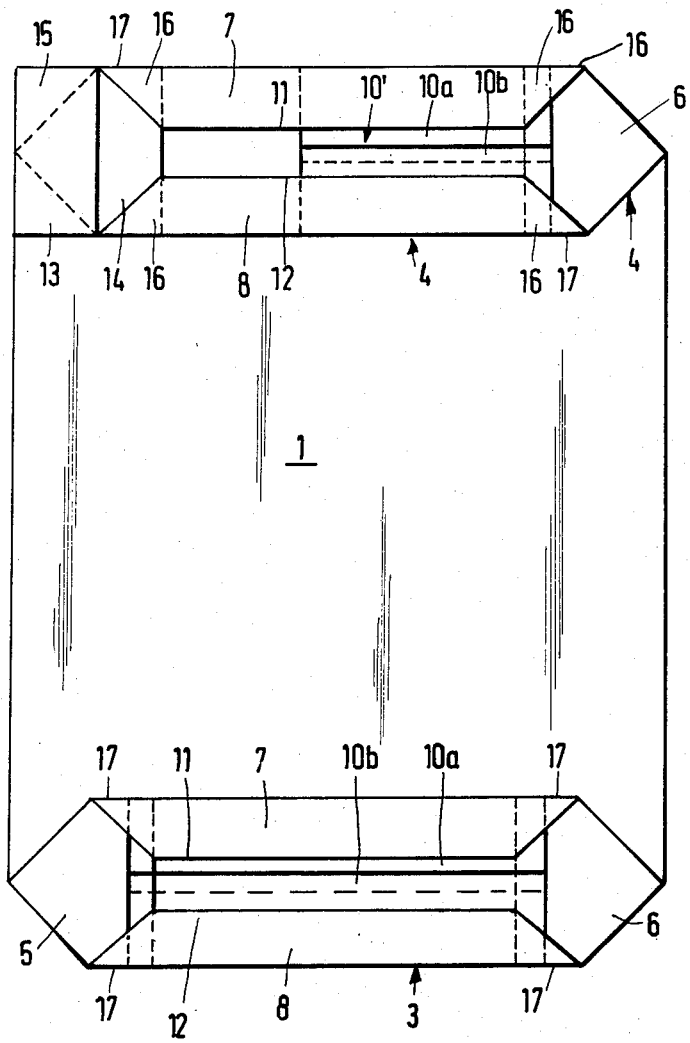
FIG. 2 is an elevational view of the bag assembly of FIG. 1 in a further assembled state.

After positioning of the sheet members 10 and 10' and the conduit member 13, the side portions 10*a* and 10*b* of the sheet members 10 and 10' including side folds 7 and 8' are sequentially folded inwardly on fold lines 9 to cause side portions 10*a* and 10*b* of the sheet members 10 and 10' to come into contact with center portions of the sheet members 10 and 10' whereby edges 11 and 12 of side folds 7 and 8 are in spaced relationship to one another, referring particuarly to FIG. 2.

Triangularly-shaped end portions 16 formed by the corner folds 5 and 6 with the side folds 7 and 8 (FIG. 1) are also folded over fold lines 9 and form a close or snug bond along the inside of fold edges 17 to minimize or eliminate the formation of any channels therebetween to prevent subsequent leakage of any product material from the bag assembly of the present invention. Generally, in order to permit facile folding as well as to enhance bonding, the thickness of the sheet members 10 and 10' is less than the thickness of the bag preform 1. As hereinabove discussed, the height dimension of sheet members 10 and 10' are selected to be larger than the dimension between edges 11 and 12 of side folds 7 and 8, and preferably are of a dimension to effect overlapping of side portions 10*a* by side portions 10*b* thereby to effect reinforcement along a center portion of bottom and top closure portions 3 and 4.

Figure 3:
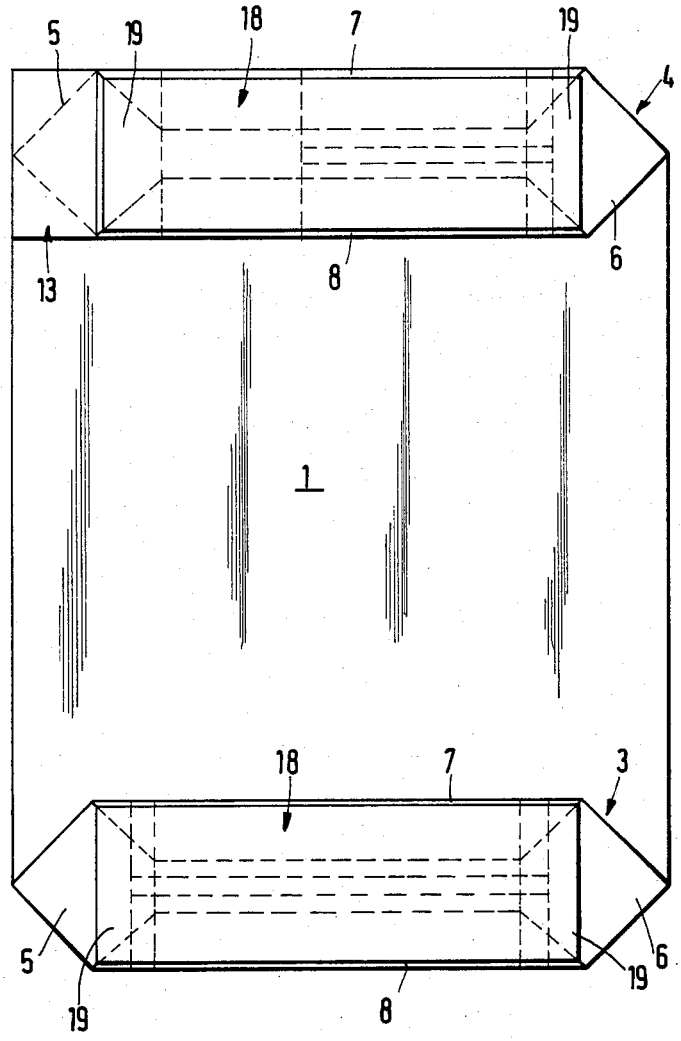
FIG. 3 is an elevational view of an assembled bag assembly of FIGS. 1 and 2 of the present invention.

The effect of folding illustrated by FIG. 2 results in outwardly positioning of adhesive layer portions 2*b* (not shown). Subsequently, outer closure sheet members 18 are positioned on and mounted to the bottom and top closure portions 3 and 4 over the folded portions of side folds 7 and 8 including adhesive layer portions 2*b*, as illustrated in FIG. 3. Bonding of the outer closure sheet members 18 is also accomplished by the use of a similar adhesive material over and about the corner folds 5 and 6 and side folds 7 and 8 which were kept adhesive-free during the prior processing steps.

The sheet members 18 including end portions 19 are dimensioned to extend beyond the side edges of sheet members 10 and 10' as well as over the sleeve portion 14 of the conduit member 13. Generally, the sheet members 18 are formed of a thickness less than the bag preform 1 to facilitate bonding and to ensure integrity of the resulting bag assembly, i.e. full force tight bonding.

Filling of the bag assembly is effected during bag assembly and is effected through the sleeve portion 14 of the conduit member 13 with the flap portion 15 thereafter being folded over and disposed under the triangularly-shaped flaps 16 and subsequently overlayered by end portions 19 of the outer sheet member 18.

Figure 4:
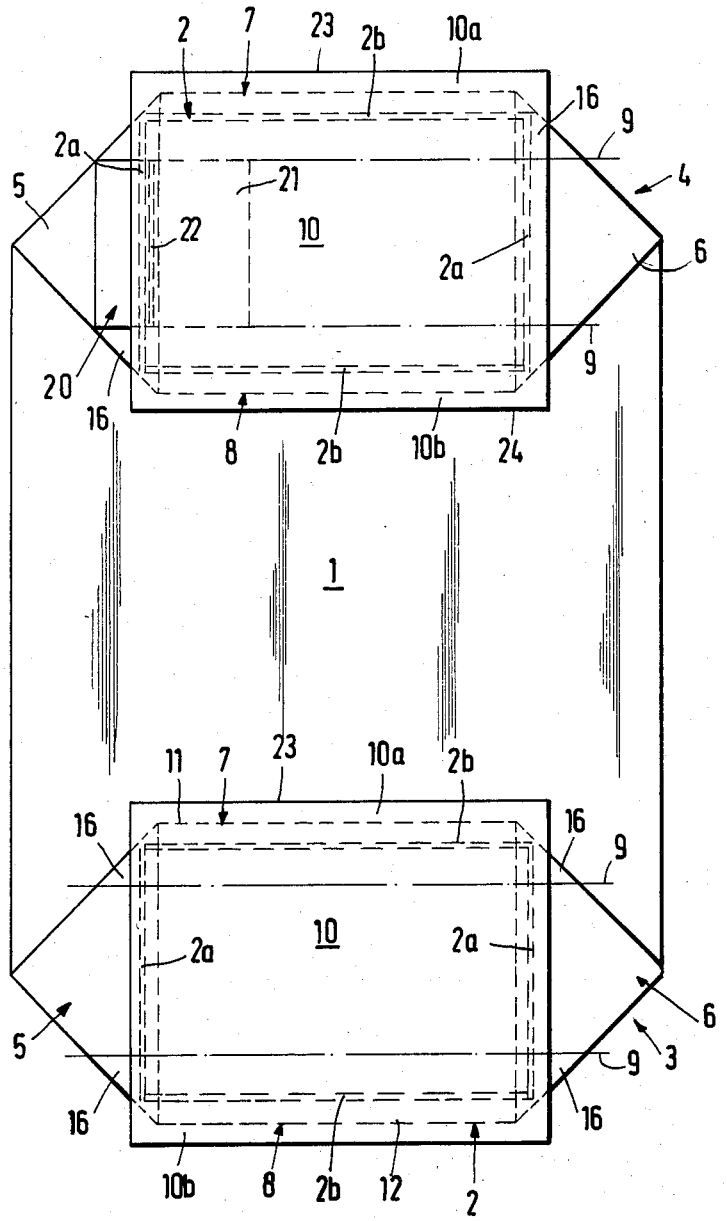
FIG. 4 is an elevational view, somewhat schematic, of another embodiment of a bag assembly of the present invention in a partially assembled state.
Figure 5:
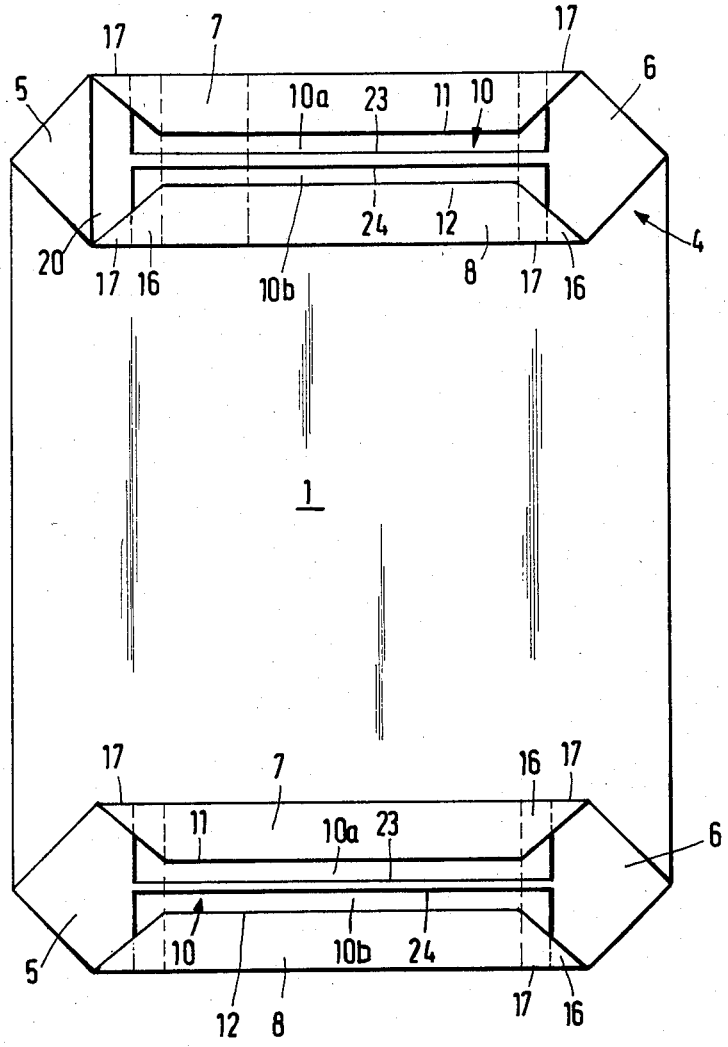
FIG. 5 is an elevational view of the bag assembly of FIG. 4 in a further assembled state.
Figure 6:
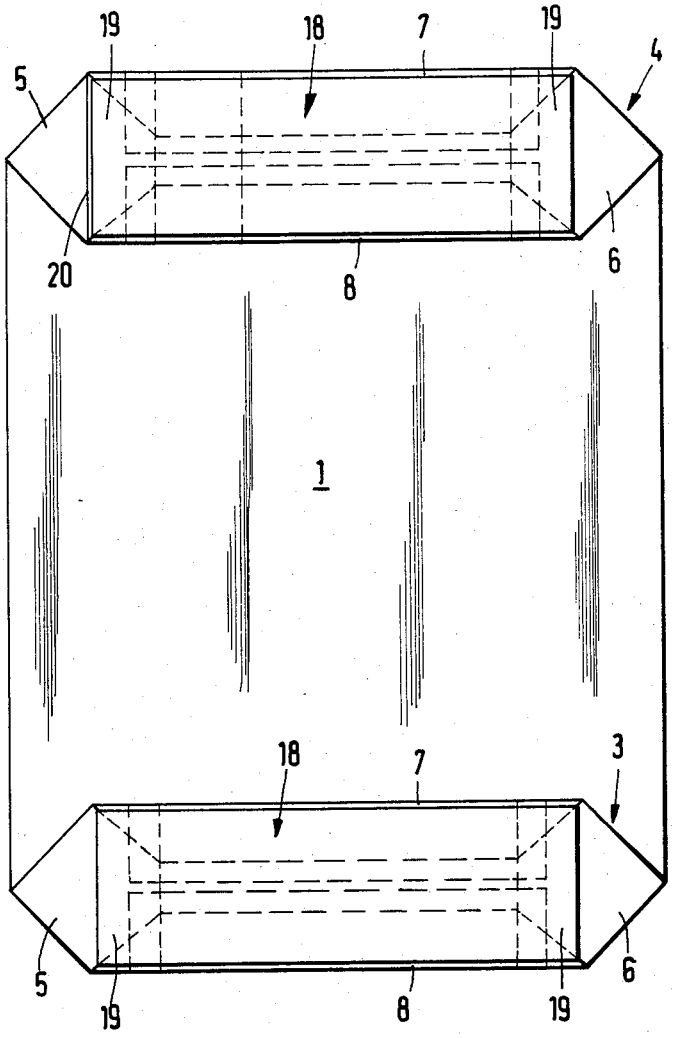
FIG. 6 is an elevational view of an assembled bag assembly of FIGS. 4 and 5.

The embodiment of the bag assembly of the present invention illustrated in FIGS. 4 to 6 is substantialy similar to the embodiment of the bag assembly of FIGS. 1 to 3, the primary difference being the configuration conduit member and a modified top closure portion 4. Referring now to FIG. 4, after deposition of the adhesive layer 2 and formation of corner folds 5 and 6 and side folds 7 and 8, a flat conduit member, generally indicated as 20, formed of an extruded tubularly-shaped thin film of plastic material is bonded to corner fold 5 by a portion of adhesive layer 2*a* disposed on corner fold 5 with an end portion 21 extending towards the bag preform 1. An upper surface portion of the conduit member 20 is provided with an adhesive layer 22 of like adhesive material as the adhesive material of adhesive layer 2.

Thereafter, adhesive-free sheet members 10 are positioned on bottom and top closure portions 3 and 4. The sheet members 10 are dimensioned such that subsequent folding of side fold portions 7 and 8 about fold line 9 results in ends 23 and 24 of sheet members 10 spaced apart from each other, referring particularly to FIG. 5, and has a favorable effect due to improved cooperation between the sheet members 18, and the adhesive layers 2*b* disposed on side folds 7 and 8 after mounting of sheet members 18 thereon. The conduit member 20 including inner portion 21 provides for essentially automatic closure thereof after filling of the bag with filler goods prior to final folding and completion of the bag assembly process. Completion of the bag assembly is effected in a manner similar to the embodiment of FIGS. 1 to 3, i.e. positioning and mounting of end closure sheet members 18 including end portions 19.

While the present invention has been described in connection with several exemplary embodiments thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed:

1. A plastic valve bag comprising:

a bag tube closed at both ends by a bottom closure and a top closure, said closures each comprising opposite pairs of corner flaps and side flaps, an inner closure sheet and an outer cover sheet, said top closure additionally comprising a valve member disposed on one of said corner flaps, a width of each of said side flaps measured transversely of said closures having less than half a width of said closures; said inner closure sheet having a width exceeding a transverse dimension of closures which is comprised of the width of each of said closures and the added widths of said two side flaps thereof; said pairs of corner flaps and side flaps, said inner closure sheet, said outer cover sheet and said valve member being bonded to said closures by adhesive coatings of a tacky contact adhesive type, said adhesive coatings being disposed peripherally along edges of said bag tube at both ends thereof and on an inner side of said cover sheet, said inner closure sheet itself being kept free of any adhesive coating and being bonded in each of said closures by part of said peripherally-disposed bag tube adhesive coating and said cover sheet adhesive coating.

2. The bag as defined in claim 1 wherein said closure sheet is dimensioned such that side portions thereof folded over commonly with said side flaps have opposing side edges which are spaced apart after folding.

3. The bag as defined in claim 1 wherein said closure sheet is dimensioned such that side portions thereof folded over commonly with said side flaps overlap each other after folding.

4. The bag as defined in claims 1, 2 or 3 wherein the thickness of said closure sheet is less than the thickness of said bag tube.

5. The bag as defined in claims 1, 2 or 3 wherein said closure sheet is of a length dimension insufficient to cover part of said peripherally-disposed bag tube adhesive coating disposed on said corner flap on which said valve member is positioned.

6. The bag as defined in claims 9, 10 or 11 wherein said valve member includes an adhesive coating on a surface opposite a surface of mounting to said corner flap to thereby permit bonding one end of said closure sheet to said valve member, the other end of said closure sheet being bonded to said corner flap opposite said valve member mounting corner flap.

7. The bag as defined in claims 1, 2 or 3 wherein each of said cover sheets is of a length dimension greater than that of said closure sheet and is bonded to both said side flaps and to said closure sheet in a region between said side flaps.

8. The bag as defined in claim 7 wherein said cover sheet of said bottom closure is of a length dimension greater than that of said closure sheet and is bonded to both said corner flaps of said bottom closure.

9. The bag as defined in claim 7 wherein said cover sheet of said top closure is of a length dimension greater than that of said closure sheet and is bonded to said valve member at its one end and to the opposing one of said corner flaps at its other end.

* * * * *

UNITED STATES PATENT AND TRADEMARK OFFICE

CERTIFICATE OF CORRECTION

PATENT NO. : 4,637,062

DATED : JANUARY 13, 1987

INVENTOR(S) : JOSEF POPPE

It is certified that error appears in the above-identified patent and that said Letters Patent is hereby corrected as shown below:

In the Abstract:

Line 11, after "folding", delete "agent".

In the Claims:

Claim 6, delete "9, 10 or 11", and substitute -- 1, 2 or 3 --.

Signed and Sealed this

Twenty-first Day of April, 1987

*Attest:*

DONALD J. QUIGG

*Attesting Officer*

*Commissioner of Patents and Trademarks*